US009021731B2

(12) United States Patent
Macy

(10) Patent No.: US 9,021,731 B2
(45) Date of Patent: May 5, 2015

(54) METHOD AND APPARATUS FOR MANAGING AMMUNITION DISPENSING FROM A MAGAZINE USING A FLEXIBLE PROJECTILE CONTROL BAR

(71) Applicant: Omar Alonso Macy, Gilroy, CA (US)

(72) Inventor: Omar Alonso Macy, Gilroy, CA (US)

(73) Assignee: Real Action Painball, Inc. (RAP4), Gilroy, CA (US)

( * ) Notice: Subject to any disclaimer, the term of this patent is extended or adjusted under 35 U.S.C. 154(b) by 0 days.

(21) Appl. No.: 14/188,289

(22) Filed: Feb. 24, 2014

(65) Prior Publication Data

US 2014/0237876 A1 Aug. 28, 2014

Related U.S. Application Data

(60) Provisional application No. 61/769,031, filed on Feb. 25, 2013.

(51) Int. Cl.
*F41A 9/61* (2006.01)
*F41A 9/68* (2006.01)

(52) U.S. Cl.
CPC ..... *F41A 9/68* (2013.01)

(58) Field of Classification Search
USPC ..... 42/49.01, 50, 49.1; 89/33.1, 33.04; 124/45, 82
See application file for complete search history.

(56) References Cited

U.S. PATENT DOCUMENTS

| | | | | |
|---|---|---|---|---|
| 4,123,963 | A * | 11/1978 | Junker | 89/152 |
| 8,739,446 | B2 * | 6/2014 | Sullivan et al. | 42/50 |
| 2012/0291324 | A1 * | 11/2012 | Bandini et al. | 42/14 |
| 2013/0247437 | A1 * | 9/2013 | Obermeit | 42/49.01 |
| 2014/0000143 | A1 * | 1/2014 | Safewright, Jr. | 42/49.02 |

* cited by examiner

*Primary Examiner* — J. Woodrow Eldred
(74) *Attorney, Agent, or Firm* — James M. Wu; JW Law Group

(57) ABSTRACT

A double-magazine ("Dmag") able to house projectile ammunition for a projectile launcher having a first ammunition channel, a second ammunition channel, and a flexible projectile control bar ("FPCB") is disclosed. In one embodiment, the first ammunition channel contains a first set or column of projectiles and the second ammunition channel which is situated in parallel to the first ammunition channel is configured to house a second set of projectiles. Dmag also includes a follower with a follower lock capable of moving along the first ammunition channel. The follower is configured to push the first set of projectiles toward a first ammunition supply port of the first ammunition channel. The FPCB has a first flexible flap which keeps the first set of projectiles from reaching the loading port of the launcher until the follower lock is released.

20 Claims, 17 Drawing Sheets

3-D view of Dmag

Perspective view of Dmag

METHOD AND APPARATUS FOR MANAGING AMMUNITION DISPENSING FROM A MAGAZINE USING A FLEXIBLE PROJECTILE CONTROL BAR

PRIORITY

This application claims the benefit of priority based upon U.S. Provisional Patent Application Ser. No. 61/769,031, filed on Feb. 25, 2013 in the name of the same inventor and entitled "Ammunition Magazine with Flexible Roll-down Bar for Projectile Supply Control," hereby incorporated into the present application by reference.

FIELD

The present invention relates to projectile propelling systems or apparatus. More specifically, the present invention relates to ammunition magazines for projectile launchers, firearms, or paintball markers.

BACKGROUND

A conventional projectile propelling system, such as a firearm or a paintball marker, is able to fire or launch ammunition continuously as long as the ammunition is available. Ammunition, for example, can be bullets for hand guns or paintballs for paintball guns. To enhance firing power, a type of projectile propelling system employs a magazine which houses more ammunition. A conventional magazine, for example, is a container loaded with ammunition in such a way that, when the magazine is attached to a firearm, the ammunition in the magazine can be sequentially loaded to a firing chamber of a launcher by a loading mechanism before launching.

For an automatic or semi-automatic firing apparatus, a projectile chamber is fired when a trigger is pulled. As soon as a projectile is fired, a retract mechanism of a firearm, for example, reloads the next projectile or bullet from the magazine for the subsequent firing. As the firing speed increases, more ammunition is needed to maintain the firing power. When ammunition in the magazine depletes, the projectile propelling system stops firing until the empty magazine is replaced with a fully loaded magazine.

To supply and provide sufficient amount of ammunition, users or operators usually carry multiple loaded magazines with a finite amount of ammunition such as bullets or paintballs in each magazine. When ammunition inside a magazine depletes, the user replaces the magazine by removing the empty magazine from the projectile propelling system such as a gun and reattaches a fully loaded magazine before a projectile can be fired. Projectile propelling is interrupted or halted during the process of replacing a magazine. To minimize firing interruption from magazine replacement, reducing the frequency of magazine replacement as well as minimum effort of magazine replacement is essential.

A conventional bottom mounted ammunition magazine includes a single column of ammunition such as paintballs with a single supply port. When the single column of ammunition is exhausted, the magazine needs to be replaced. A problem associated with such a conventional ammunition magazine is that it holds a limited amount of ammunition or projectiles.

SUMMARY

One embodiment of the present invention discloses a double-magazine ("Dmag") capable of housing two columns of projectile ammunition with a controlled dispensing mechanism. Dmag, in one aspect, includes a first ammunition channel, a second ammunition channel, and a controlled dispensing mechanism. The controlled dispensing mechanism includes multiple flexible projectile control bars ("FPCBs"). The first ammunition channel contains a first set or column of projectiles and the second ammunition channel which is situated in parallel to the first ammunition channel is configured to house a second column of the projectiles.

Dmag also includes a follower with a follower lock capable of moving inside of the first ammunition channel. The follower is configured to push the first set of projectiles toward a first ammunition supply port of the first ammunition channel. The controlled dispensing mechanism uses one or more FPCBs to control projectiles from dispensing unless a switch, also known as magazine well ("mag-well") release, is triggered. For example, each FPCB has a flexible flap which keeps the column of projectiles from dispensing or reaching to the loading port of the launcher until the release is triggered.

Additional features and benefits of the exemplary embodiment(s) of the present invention will become apparent from the detailed description, figures and claims set forth below.

BRIEF DESCRIPTION OF THE DRAWINGS

Exemplary embodiment(s) of the present invention will be understood more fully from the detailed description given below and from the accompanying drawings of various embodiments of the invention, which, however, should not be taken to limit the invention to the specific embodiments, but are for explanation and understanding only.

DETAILED DESCRIPTION

Figure 1:
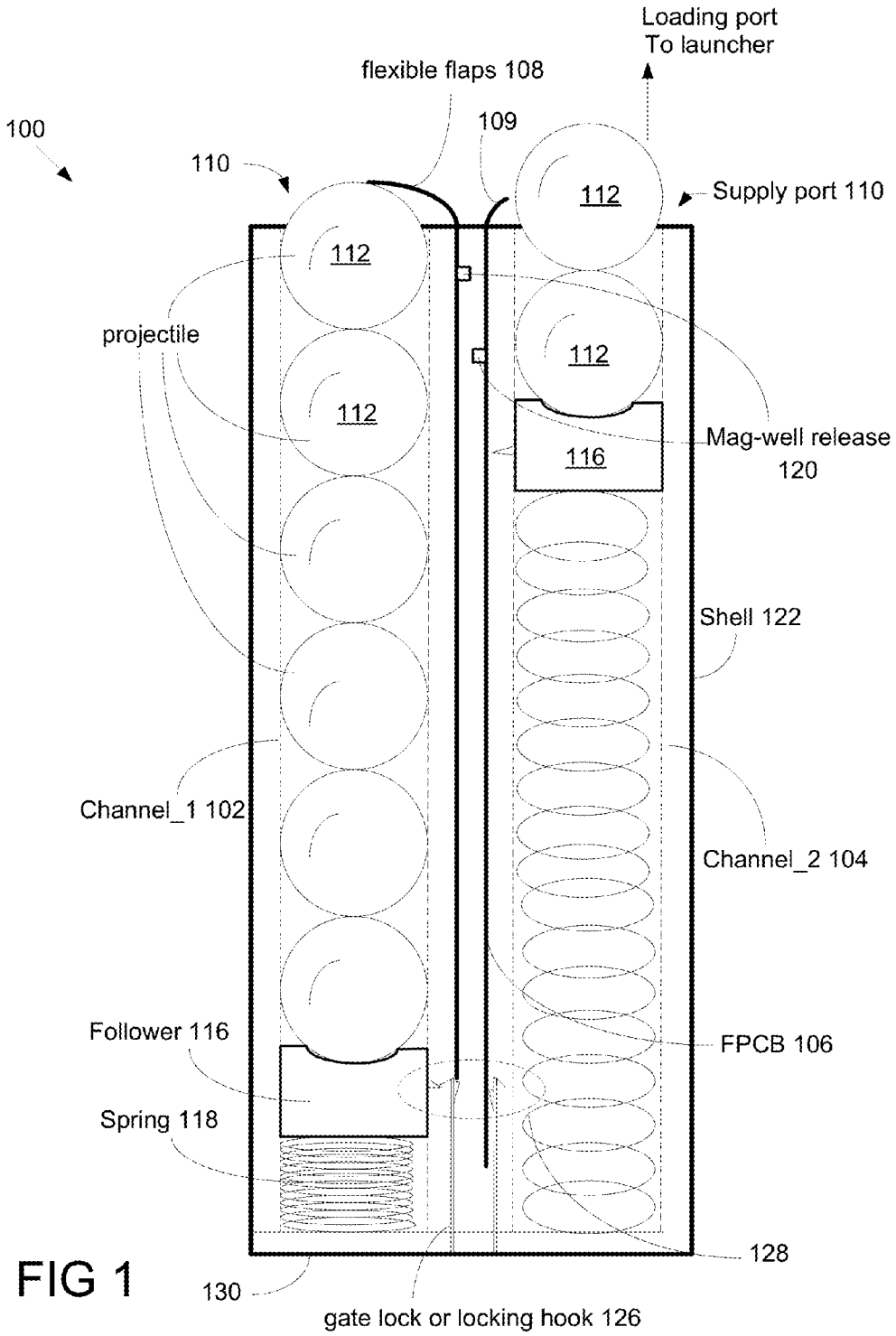
FIG. 1 is a block diagram illustrating a double-magazine ("Dmag") having two supply ports capable of carrying ammunition in columns configuration in accordance with one embodiment of the present invention.

Exemplary embodiment(s) of the present invention is described herein in the context of a method, system and apparatus of providing ammunition to a projectile propelling system or projectile launcher using a double-magazine ("Dmag") which contains two columns of projectiles.

Those of ordinary skills in the art will realize that the following detailed description of the exemplary embodiment (s) is illustrative only and is not intended to be in any way limiting. Other embodiments will readily suggest themselves to such skilled persons having the benefit of this disclosure. Reference will now be made in detail to implementations of the exemplary embodiment(s) as illustrated in the accompanying drawings. The same reference indicators will be used throughout the drawings and the following detailed description to refer to the same or like parts.

References to "one embodiment," "an embodiment," "example embodiment," "various embodiments," "exemplary embodiment," "one aspect," "an aspect," "exemplary aspect," "various aspects," etc., indicate that the embodiment (s) of the invention so described may include a particular feature, structure, or characteristic, but not every embodiment necessarily includes the particular feature, structure, or characteristic. Further, repeated use of the phrase "in one embodiment" does not necessarily refer to the same embodiment, although it may.

In the interest of clarity, not all of the routine features of the implementations described herein are shown and described. It will, of course, be understood that in the development of any such actual implementation, numerous implementation-specific decisions may be made in order to achieve the developer's specific goals, such as compliance with application- and business-related constraints, and that these specific goals will vary from one implementation to another and from one developer to another. Moreover, it will be understood that such a development effort might be complex and time-consuming, but would nevertheless be a routine undertaking of engineering for those of ordinary skills in the art having the benefit of this disclosure.

Various embodiments of the present invention illustrated in the drawings may not be drawn to scale. Rather, the dimensions of the various features may be expanded or reduced for clarity. In addition, some of the drawings may be simplified for clarity. Thus, the drawings may not depict all of the components of a given apparatus (e.g., device) or method.

As used herein, the singular forms of article "a", "an" and "the" are intended to include the plural forms as well, unless the context clearly indicates otherwise. Also, the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. The term "and/or" includes any and all combinations of one or more of the associated listed items.

One embodiment of the present invention discloses a Dmag capable of housing two columns of projectile ammunition with a controlled dispensing mechanism. Dmag, in one aspect, includes a first ammunition channel, a second ammunition channel, and a controlled dispensing mechanism. The controlled dispensing mechanism includes multiple flexible projectile control bars ("FPCBs"). The first ammunition channel contains a first set or column of projectiles and the second ammunition channel which is situated in parallel to the first ammunition channel is configured to house a second set of projectiles.

Dmag also includes a follower with a follower lock capable of moving along the first ammunition channel. The follower is configured to push the first set of projectiles toward a first ammunition supply port of the first ammunition channel. The controlled dispensing mechanism uses one or more FPCBs to control projectiles from dispensing unless a switch, also known as mag-well release, is released. For example, each FPCB has a flexible flap which keeps a set of projectiles from dispensing or reaching to the loading port of the launcher until the follower lock or mag-well release is triggered.

FIG. 1 is a block diagram 100 illustrating a Dmag having two supply ports 110 capable of housing ammunition such as projectiles 112 organized in columns configuration in accordance with one embodiment of the present invention. Diagram 100 includes a shell 122, a bottom plate 130, multiple projectiles 112, and FPCBs 106. Shell 122, in one aspect, is configured to have two columns or channels 102-104 wherein each channel 102 or 104 is configured to store or house a column of projectiles 112 organized in a sequential order. For example, the projectile situated on the top of column leaves ammunition channel 102 first. Similarly, the projectile that situated at the bottom of column is the last one to leaves ammunition channel 102. It should be noted that the underlying concept of the exemplary embodiment(s) of the present invention would not change if one or more components (or units) were added to or removed from diagram 100.

Shell, in one example, is structured or organized to contain two columns or channels 102-104 wherein one end of channel is supply port 110 and the other end of channel is coupled to bottom plate 130. Each channel 102 or 104, also referred to as ammunition channel, is configured to have a column shape in which a column of projectiles 112 which is one projectile on top of another projectile is stored in the channel. The column of projectiles 112, in one aspect, is pushed or guided by a follower 116 with a spring force provided by a spring 118. In one aspect, follower 116 coupled to spring 118 is able to provide a predefined constant dispensing force or pressure that pushes projectiles toward to supply port 110.

When Dmag is coupled with a projectile launcher, not shown in FIG. 1, Dmag supplies projectiles to the launcher one column at a time. The projectile launcher, in one example, includes a receiver configured to couple to the Dmag. The receiver further contains a propelling mechanism and an ammunition receiving port, wherein the propelling mechanism is used for launching projectiles. The ammunition receiving port as part of magazine well, which may be situated at the bottom of the receiver, is used to couple to the Dmag for receiving projectiles and/or ammunition. It should be noted that the projectile launchers can also be referred to as firearms, lethal weapon, non-lethal weapon, paintball markers, tranquilizing guns, projectile delivery systems, and the like.

The projectile or ammunition can be any types of substance delivery capsules such as paintballs, lethal delivery capsules, non-lethal delivery capsules, chemical delivery balls, bullet, and the like. For example, paintballs usually include non-toxic, biodegradable, water soluble color substance wherein they leave colored marks upon breakage. A bullet, on the other hand, is generally made of cylindrical metal shell that can be expelled from a firearm, especially a rifle or handgun.

Each channel 102 or 104 includes a spring 118 wherein one end of spring 118 attaches to the bottom section of follower 116 while another end of spring 118 couples to bottom plate 130. When spring 118 can be flexibly compressed in accordance with the number of projectiles 112 in the channel, spring 118 generates a spring force pushing projectiles 112 away from bottom plate 130. Because of the constant spring force, projectiles 112 can easily reach to the loading port of a receiver passing through supply port 110 when Dmag is coupled to a launcher.

To store and control projectiles 112 from unintended dispensing from the Dmag, a locking mechanism 126 and FPCBs 106 are used to control or manage dispensing of projectiles to improve unintended dispensing of ammunition. For example, when FPCB 106 is in a looking position in response to gate lock or looking hook 126, flexible flap 108 of FPCB 106 leans over from the center of Dmag to the channel opening or supply ports 110 to block projectiles from leaving the channel 102 unless the lock is released or the mag-well release is triggered.

Upon triggering of the lock or mag-well release, FPCB 106 rolls down to retract (or remove) flexible flap 109 from covering a portion of supply port 110. Once flexible flap 109 rolls down or retracts, projectile 112 within channel 104 can freely move to the loading port of launcher for launching. A function of FPCB 106 is to keep or maintain the projectiles in the ammunition channel unless a user is ready to fire.

Dmag, in one embodiment, includes first ammunition channel 102, second ammunition channel 104, first followers 116, and FPCBs 106. First ammunition channel 102 is used to house a first column of projectiles 112 and second ammunition channel 104 houses a second column or set of projectiles 112. In one example, the projectiles are paintballs. Alternatively, the projectiles are breakable lethal delivery capsules. First follower 116 is able to move inside of first ammunition channel 102 to push the first column of projectiles toward a first ammunition supply port 110 for supplying ammunition.

First FPCB 106, which is situated adjacent to first ammunition channel 102, is configured to have a first flexible flap 108 to extend from one end of the first FPCB to the middle of supply port 110. Note that the first flexible flap is configured to keep the first set of projectiles from reaching loading port of a launcher until the first follower lock is released. First FPCB 106 is able to roll down toward or retract toward the bottom of Dmag for ammunition supply when the Dmag is engaged to a projectile launcher.

Dmag also includes a first spring 118, a shell 122, and a first gate lock 126 wherein the top end of first spring 118 attaches to the bottom side of first follower 116 and the bottom end of first spring 118 attaches to the bottom portion of first ammunition channel 102 or bottom plate 130. Shell 122 is structured in such a way that it houses first ammunition channel 102, second ammunition channel 104, and first FPCB 106. It should be noted that shell 122 can be structure to include more than two ammunition channels. The top end of shell 122 includes several supply ports and the bottom end of shell 122 contains one or more flanges used to facilitate engagement to bottom plate 130.

First gate lock 126 situated adjacent to bottom plate 130 is configured to lock first follower 116 in a predefined position within first ammunition channel 102. In one example, bottom plate 130 is formed by two or four substantially identical bottom pieces. Each of the bottom piece includes a locking hook or a groove. The bottom piece is attached to shell 122 by sliding the flange of shell 122 into the groove of bottom pieces to form a bottom plate 130.

Dmag further includes a second follower 116 and a second FPCB 106 for implementing second ammunition channel 104. Second follower 116, in one aspect, is able to move inside of second ammunition channel 104 to push the second column of projectiles 112 toward a second ammunition supply port 110 of second ammunition channel 104. Second FPCB 106, which is situated adjacent to first FPCB 106, is configured to have a second flexible flap 109 extending from one end of second FPCB 106. Second flexible flap 109 is configured to keep the second column of projectiles 112 from leaving second ammunition channel 104 until the mag-well release is triggered.

An advantage of using a Dmag is that Dmag provides two or more columns of ammunition to increase overall capacity of ammunition.

Figure 2:
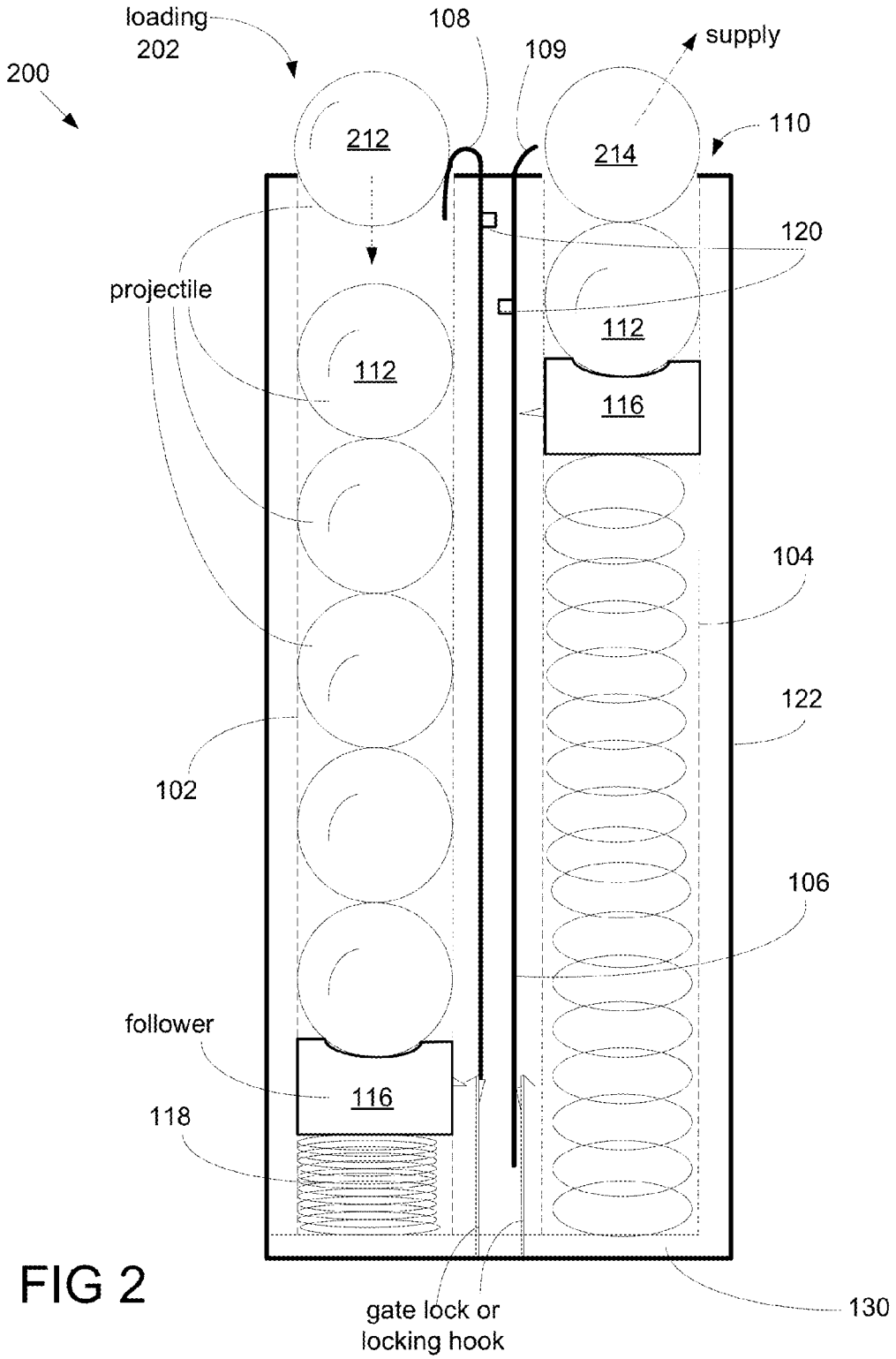
FIG. 2 is a block diagram illustrating loading as well as dispensing projectiles to and from Dmag in accordance with one embodiment of the present invention.

FIG. 2 is a diagram 200 illustrating a Dmag showing a process of loading as well as dispensing projectiles in accordance with one embodiment of the present invention. Diagram 200, which is similar to diagram 100, includes shell 122, bottom plate 130, multiple projectiles 112, and FPCBs 106. Shell 122, in one aspect, has two columns or channels 102-104 for storing or housing projectiles 112. Flexible flaps of FPCBs 106, in one embodiment, are fabricated with flexible or soft material which possesses physical properties that has sufficient stiffness to keep projectiles in the ammunition channels while soft enough for bending during a loading process.

For example, during a loading process 202, a projectile 212 is pushed or loaded into ammunition channel 102 via supply port 110. When projectile 212 contacts with flexible flap 108, flexible flap 108, which is sufficient flexible, is bent into channel 102 whereby allowing projectile 212 to pass through supply port 110 for storage. Flexible flap 109, for example, is in a rolled down position whereby projectile 214 is free to leave ammunition channel 104.

It should be noted that the diagram 200 shows two-channel Dmag to simplify the illustration of the present embodiment of invention. Additional channels can be added to Dmag to further increase the ammunition capacity.

Figure 3:
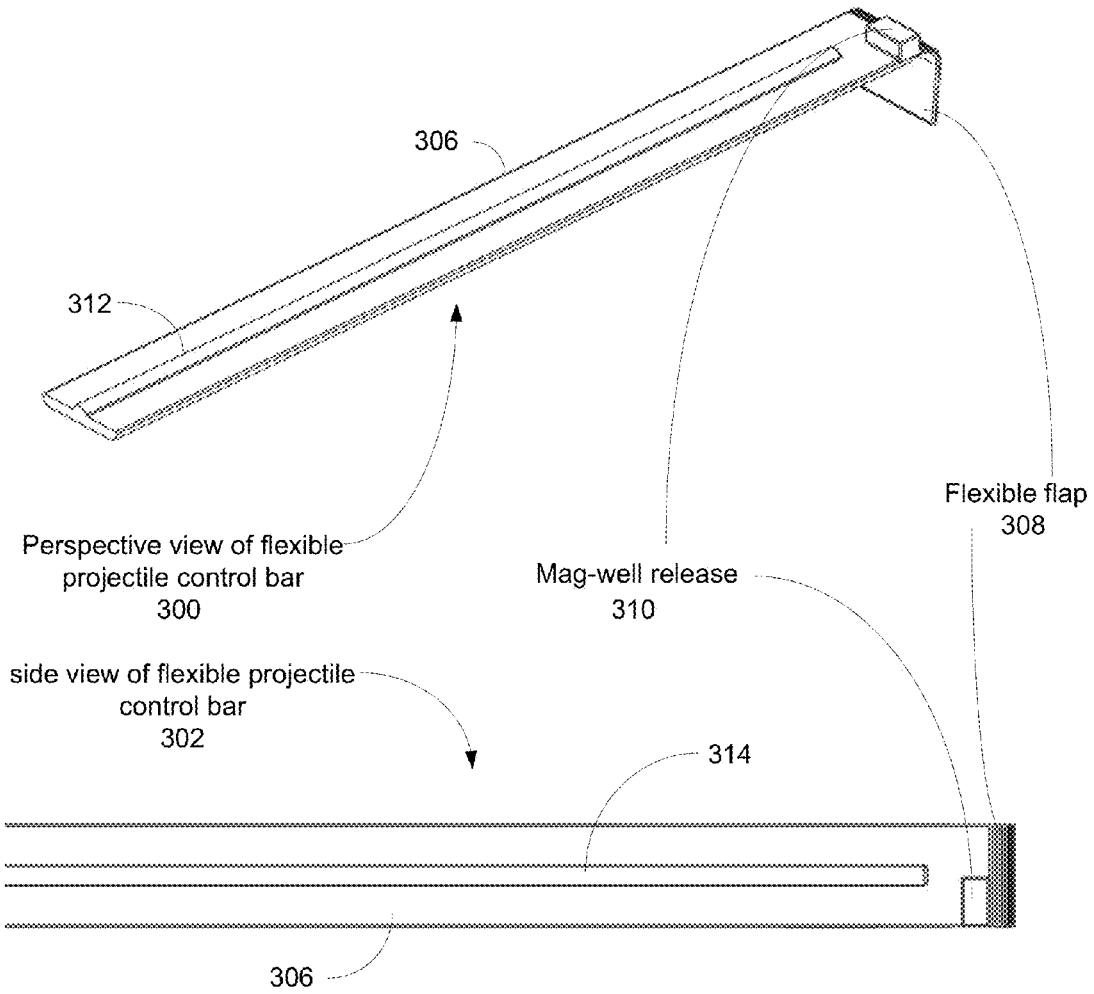
FIGS. 3-4 are diagrams showing a flexible projectile control bar ("FPCB") or a roll down bar for managing projectiles stored in Dmag in accordance with embodiments of the present invention.
Figure 4:
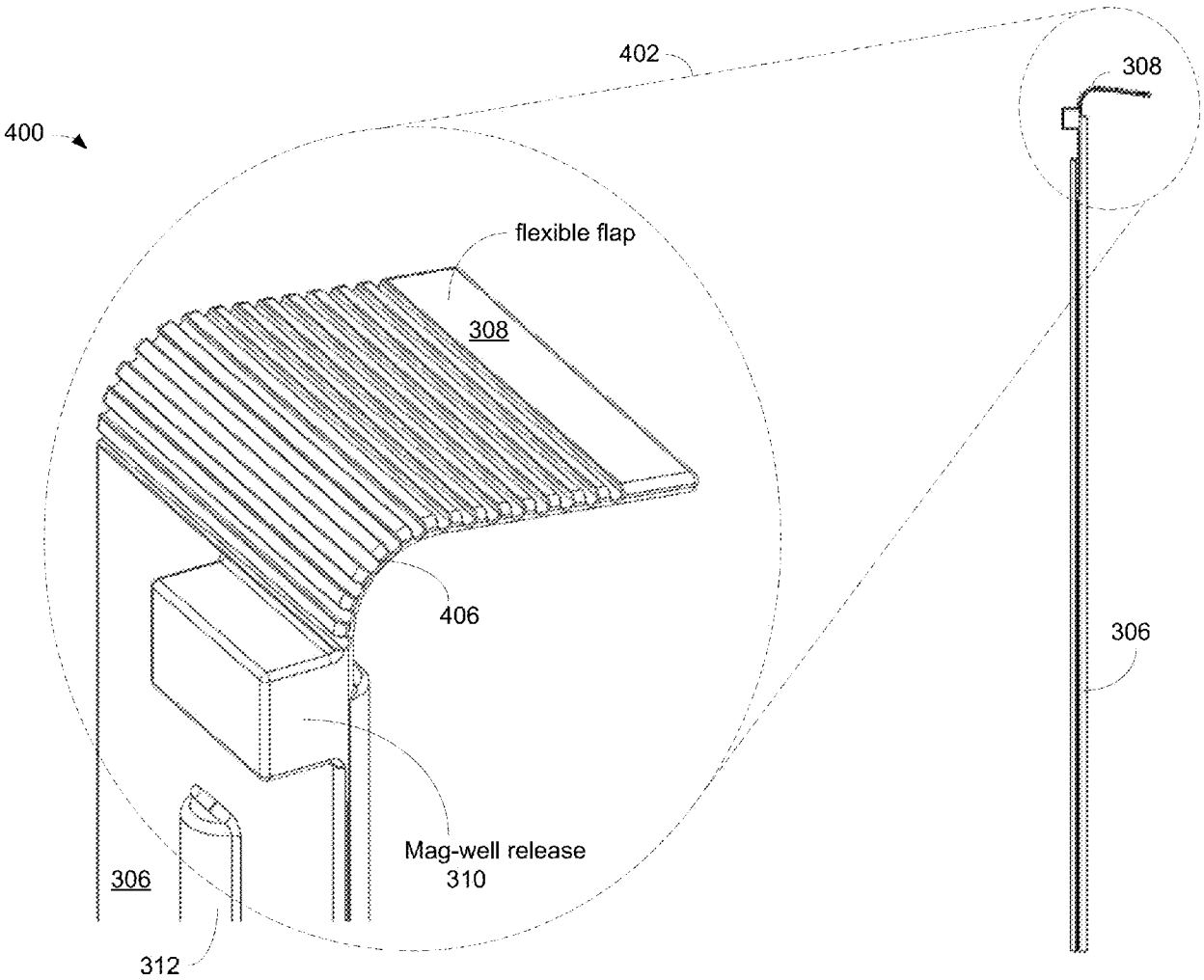

FIGS. 3-4 are diagrams 300-302 and 400 showing FPCB 306 or a roll down bar used in Dmag capable of controlling projectile dispensing in accordance with embodiments of the present invention. Diagram 300 illustrates a perspective view of FPCB 306 and diagram 302 illustrates a side view of FPCB 306. Diagram 400 illustrates an explored view of flexible flap 408 which includes a bendable portion 406 that is specifically configured or structured to perform the function of controlled dispensing and loading. FPCB 306 includes a mag-well release 310 and flexible flap 308 wherein flexible flap 308 is capable of bending when it encounters a loading force for ammunition replenishing or loading. Mag-well release 310, in one aspect, is used to roll down FPCB 306 when Dmag is coupled to a magazine well of a receiver. For example, when the receiver of launcher pushes down mag-well release 310 as Dmag plugs into the receiver, the channel of Dmag that flexible flap has retracted or rolled down will supplies ammunition such as projectiles to the launcher.

Figure 5:
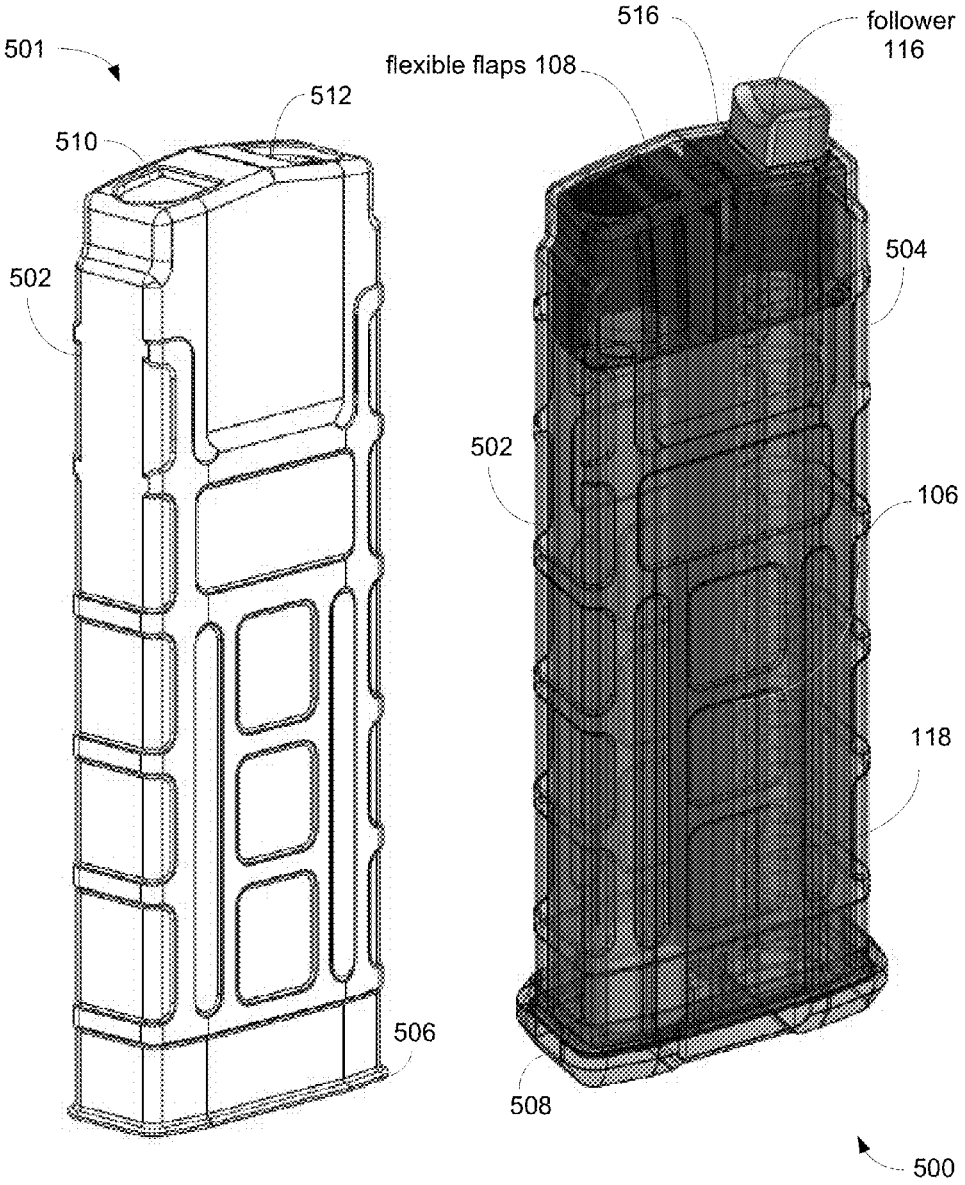
FIGS. 5-6 are exemplary illustrations showing a Dmag in accordance with one embodiment of the present invention.

FIG. 5 illustrates a diagram 501 showing a 3-dimensional ("3D") view of shell 502 and a diagram 500 showing a semi-transparent view of Dmag 504 in accordance with one embodiment of the present invention. Shell 502 includes a first supply port 510 and a second supply port 512 wherein both supply ports 510-512, in one aspect, are configured to be part of channels or columns for ammunition or projectile storage. It should be noted that supply ports 510-512 are also used for ammunition loading. Shell 502 also includes a flange 506 which is used to anchor bottom plate 508 to shell 502.

Dmag 504 illustrates shell 502, bottom plate 508, follower 116, spring 118, flexible flap 106, and a retracted flexible flap 516. In one aspect, FPCBs 106 are placed in the center part of shell 502 or Dmag 504. Alternatively, FPCBs 106 can also be placed at the edge of shell 502. Bottom plate 508 is attached to shell 502 via flange 506.

One advantage of employing Dmag is that it can be assembled or disassembled without use of tools.

Figure 6:
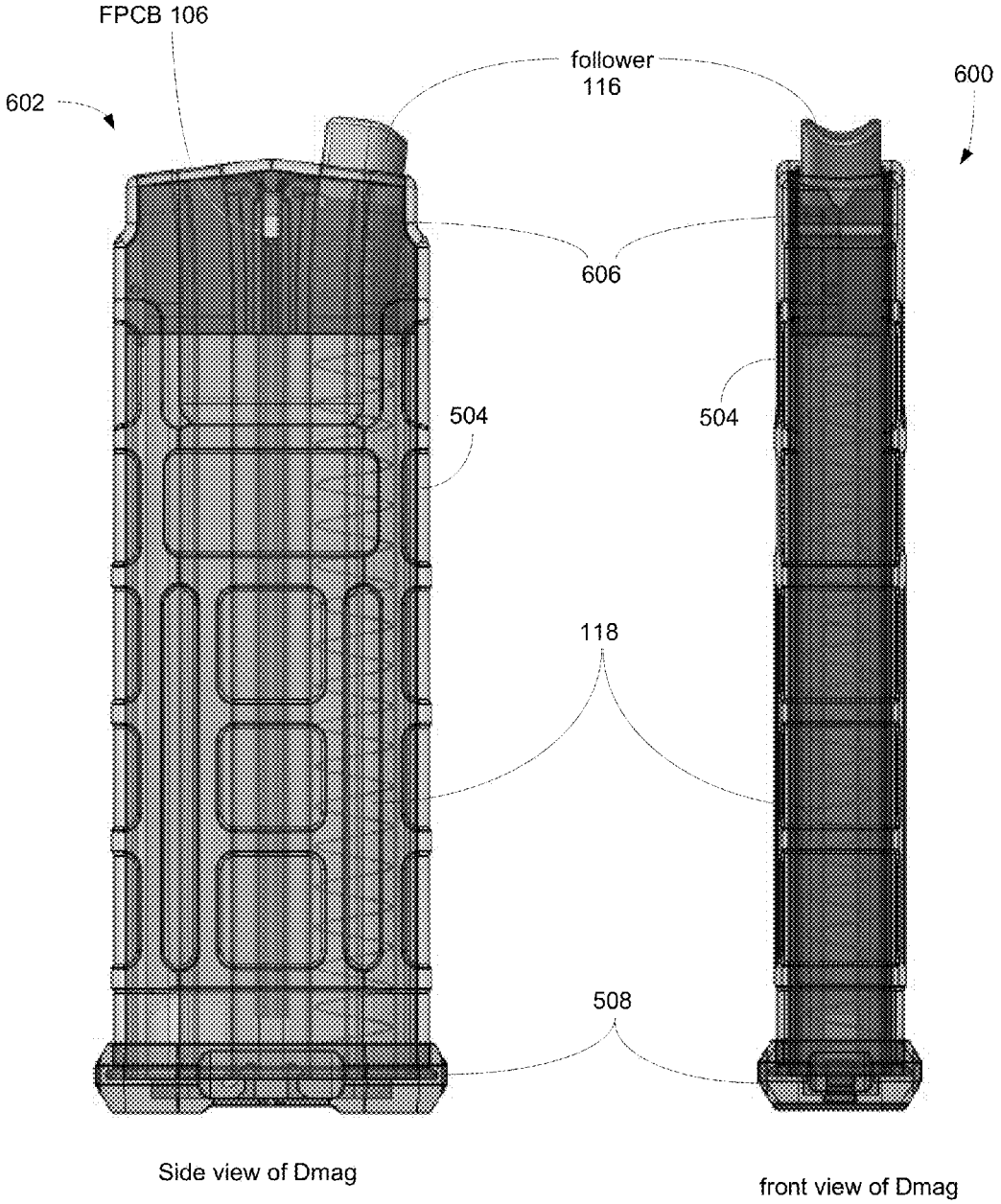

FIG. 6 depicts semi-transparent diagrams 600-602 illustrating at least portions of internal components of Dmag 504 in accordance with one embodiment of the present invention. Diagrams 600-602, which are similar to diagram 500 shown in FIG. 5, illustrates follower 116, feed ramp 606, spring 118, FPCB 106, and bottom plate 508. Diagram 600, for example, shows a perspective front view of Dmag 504 and diagram 602 shows a perspective side view of Dmag 504. Feed ramp 606, in one example, is constructed with relatively ridge material and is situated on top of an extruder inside of shell to reinforce or support the supply ports as well as movement of FPCB 106. Alternatively, feed ramp 606 is fabricated together with an extruder as one single unit or component. Furthermore, feed ramp 606 may be configured to house at least a portion of the extruder. Also, shell, feed ramp 60, and extruder may be structured in a single component or device.

Figure 7:
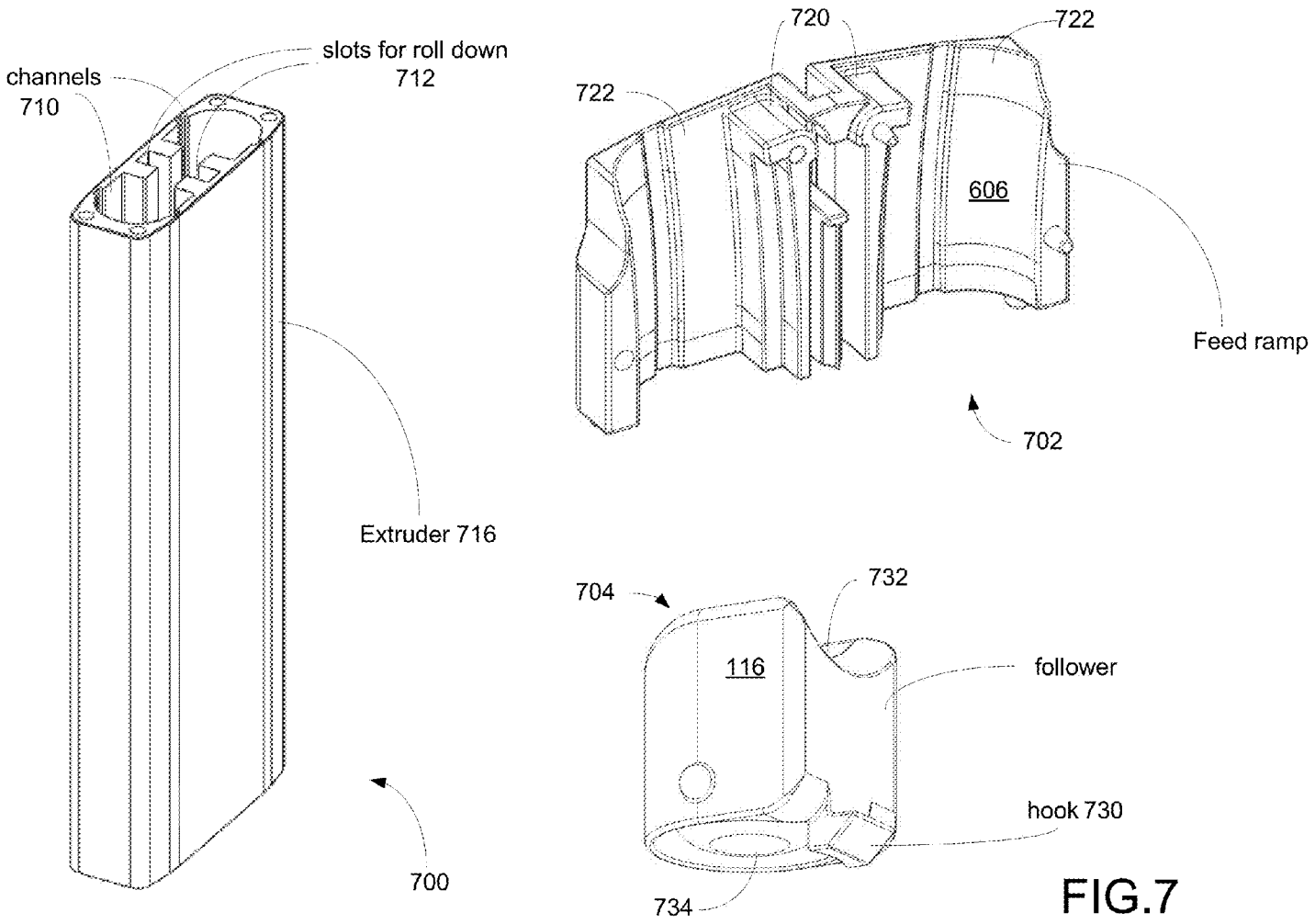
FIG. 7 depicts exemplary illustrations showing various components of Dmag in accordance with one embodiment of the present invention.

FIG. 7 depicts several exemplary diagrams 700-704 illustrating several internal components used in the Dmag in accordance with one embodiment of the present invention. Diagram 700, for example, is an extruder 716 containing two channels 710 and two slots 712. While channels 710 are used for storing columns of projectiles, slots 712 are used to facilitate or guide the movement of FPCBs 106. For example, FPCB 106 is able to roll down its flexible flap along slot 712 to unblock the supply port(s). Extruder 716, which is made by relatively rigid material, is structured to fit inside of the shell whereby the shell is structurally reinforced.

Diagram 702, in one embodiment, illustrates an open view or a cutaway view of feed ramp 606 used to facilitate projectile dispensing, projectile loading, and FPCB movement. Feed ramp 606, which includes two supply ports 722 and two slots, is configured to fit inside of the shell. In one aspect, feed ramp 606 is situated on top of extruder 716 inside of the shell. Alternatively, extruder 716 is partially inserted into feed ramp 606 when both feed ramp 606 and extruder 716 are slide into the shell.

Diagram 704 shows a follower 116 having a hook 730, a projectile seat 732, and a spring anchor 734 wherein spring anchor 734 is used to attach to a spring. Hook 730, also known as follower lock, is used to keep follower 116 in a stationary position until hook 730 is released. Seat 732 is used in contact with a projectile. Upon release of hook 730, seat 732 pushes a column of projectiles toward the supply port of Dmag. Note that seat 732 is structured in a concave half-spherical shape to reduce the pressure to a round-shaped projectile(s) (i.e. paintball) to minimize projectile breakage during the process of pushing.

Figure 8:
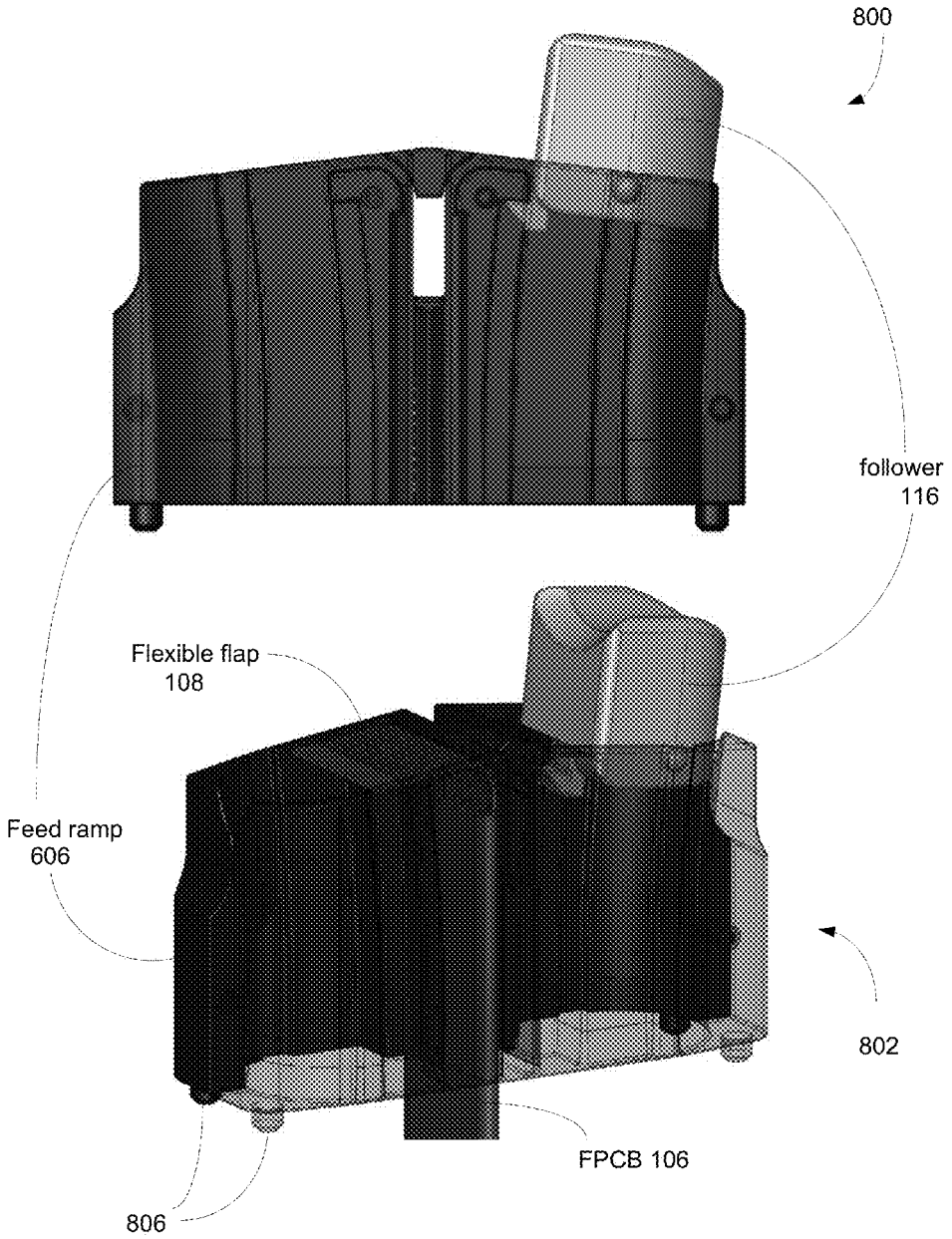
FIG. 8 illustrates a feed ramp used as an internal component of Dmag in accordance with one embodiment of the present invention.

FIG. 8 illustrates diagrams 800-802 illustrating transparent views of feed ramp 606 in accordance with one embodiment of the present invention. Diagram 800 illustrates a side view of feed ramp 606 and diagram 802 shows a perspective view of feed ramp 606. Feed ramp 606, in one embodiment, includes protruding posts, or pins, or dowels 806 that are used to couple to extruder 716 shown in FIG. 7. Feed ramp 606 also includes two supply ports wherein the opening of each port is structure in a slightly downward angle from the center of the feed ramp 606 to facilitate projectile loading.

Figure 9:
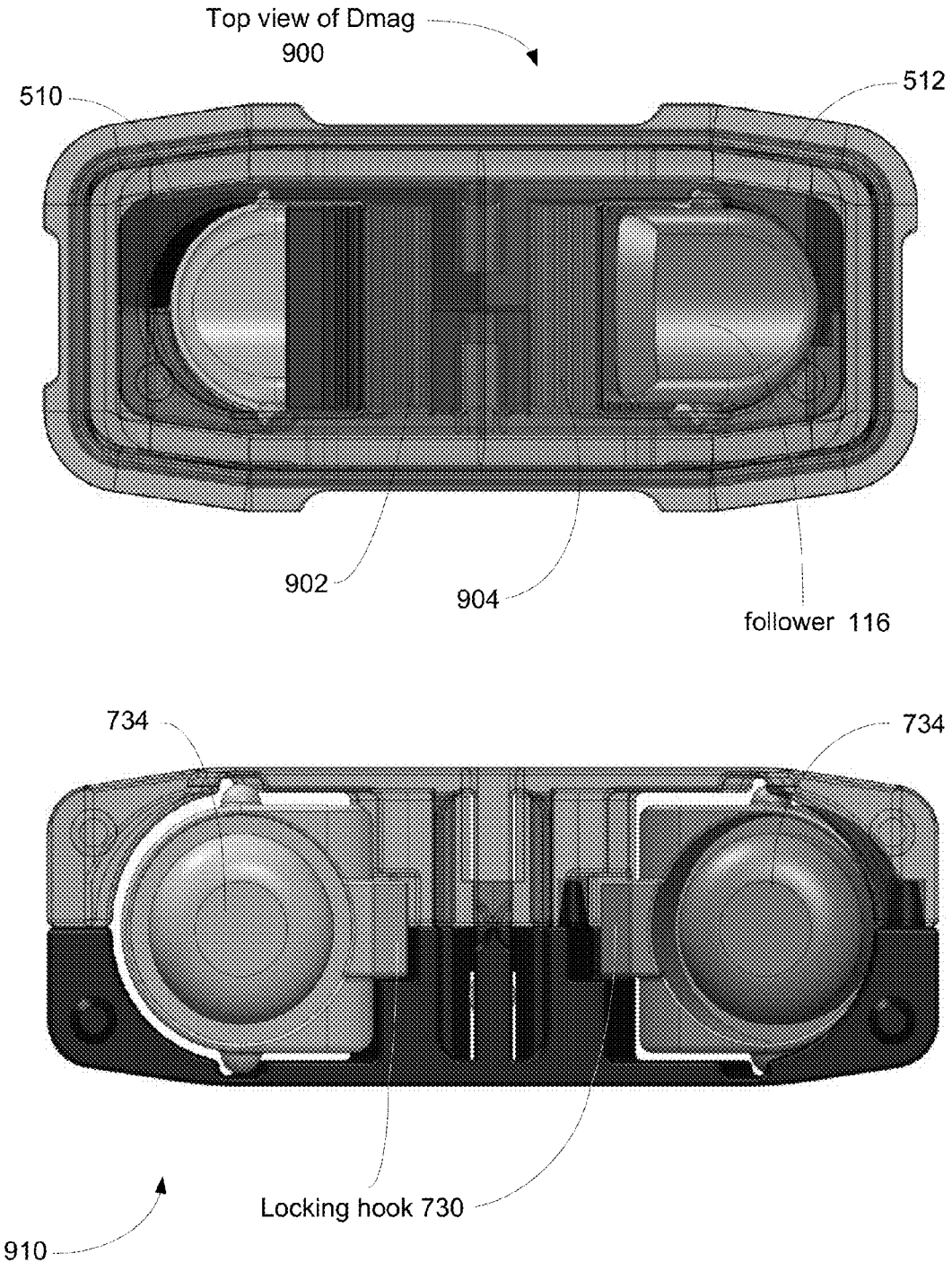
FIG. 9 is a diagram illustrating a top view of Dmag and a view of internal structure of Dmag in accordance with one embodiment of the invention.

FIG. 9 depicts diagrams 900 and 910 illustrating top and bottom views of Dmag in accordance with one embodiment of the invention. Diagram 900 shows a top view of Dmag and diagram 910 shows a view of internal structure of Dmag. Diagram 900 shows follower 116, supply ports 510-512, and flexible flaps 902-904. Flexible flap 902 is in an engaging position that will prevent any projectiles to leave from supply port 510 while flexible flap 904 is in a roll down position that will allow projectiles to leave from supply port 512. Diagram 910 shows a bottom view of followers 734 with locking hooks 730.

Figure 10:
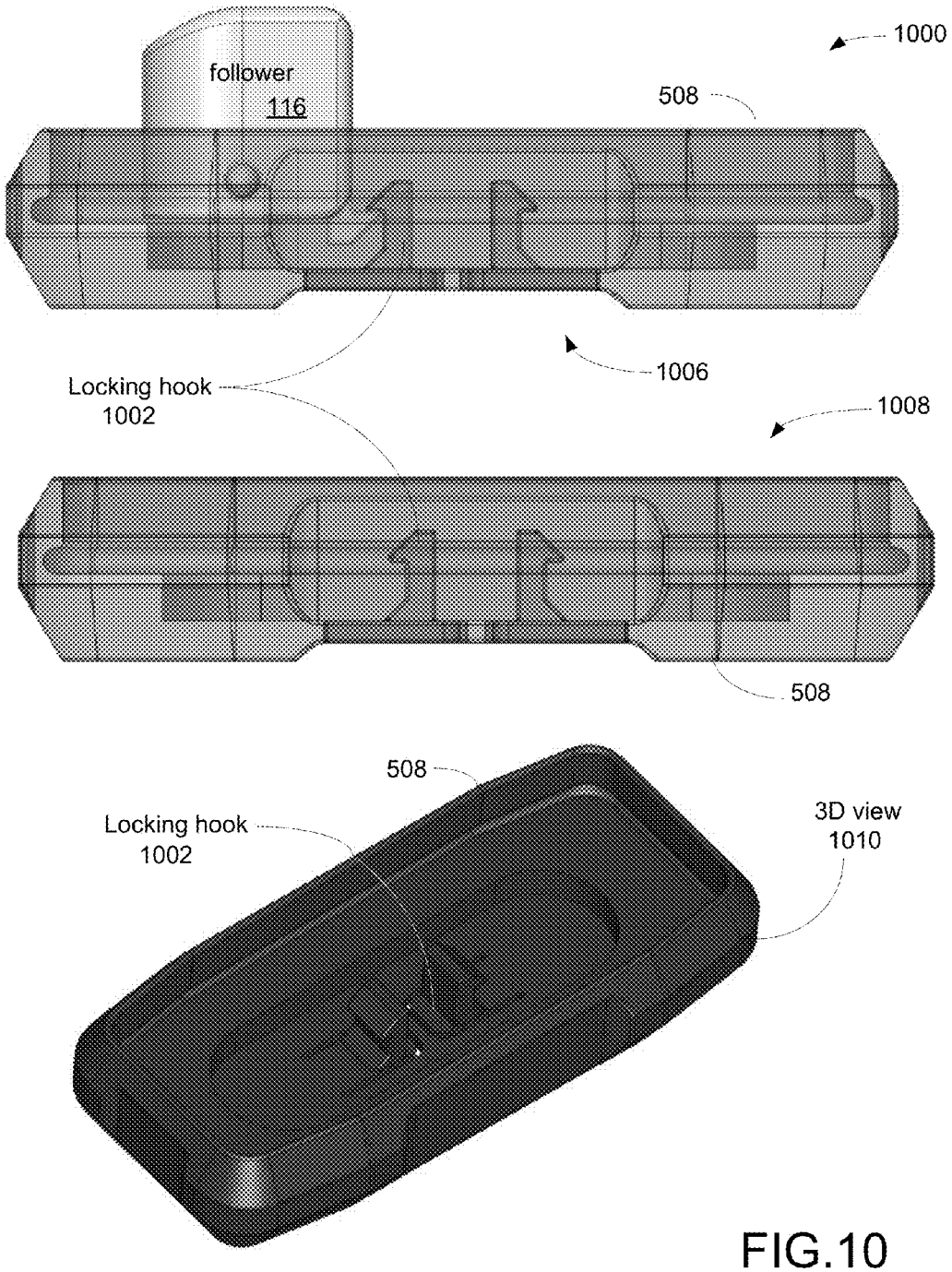
FIG. 10 is exemplary illustrations showing bottom component or bottom plate of Dmag in accordance with one embodiment of the present invention.

FIG. 10 depicts several exemplary illustrations showing different views of bottom plate 508 or bottom component of Dmag in accordance with one embodiment of the present invention. In one aspect, bottom plate 508 can be assembled or disassembled to two or four different pieces. Diagram 1000 illustrates bottom plate 508 with a follower 116 that is locked into a locking hook 1002. Hook release 1006 may be used to release follower 116 from a stationary position to an active position. Diagram 1008 shows bottom plate 508 without follower 116. Diagram 1010 illustrates a 3D view of bottom plate for Dmag with a configuration of locking hooks 1002. The groove(s) shown in bottom plate 508 are used to fit into flanges of a shell for assembly the bottom plate or portion of Dmag.

Figure 11:
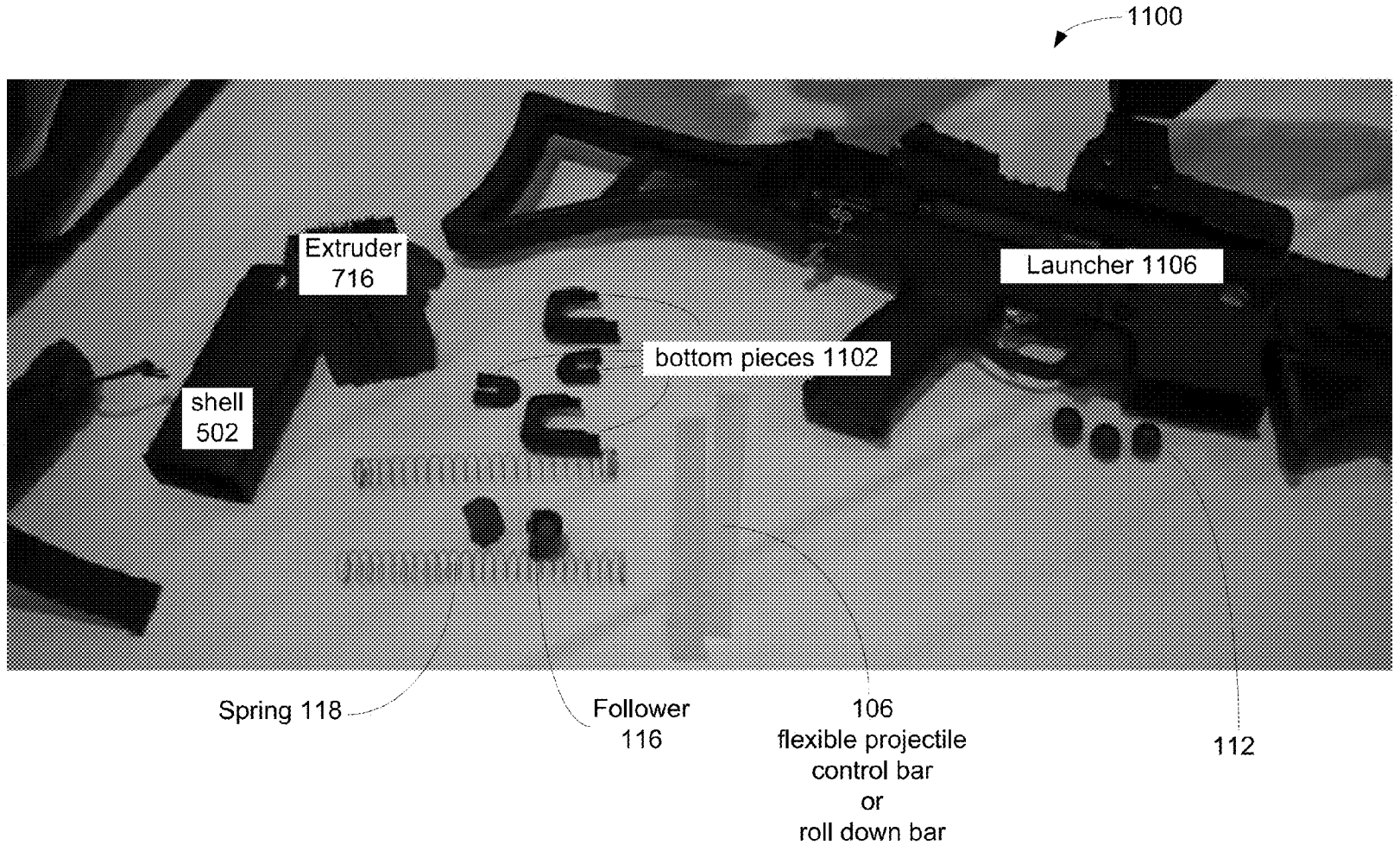
FIGS. 11-13 illustrate a tool-less Dmag assembly process in accordance with one embodiment of the present invention.
Figure 12:
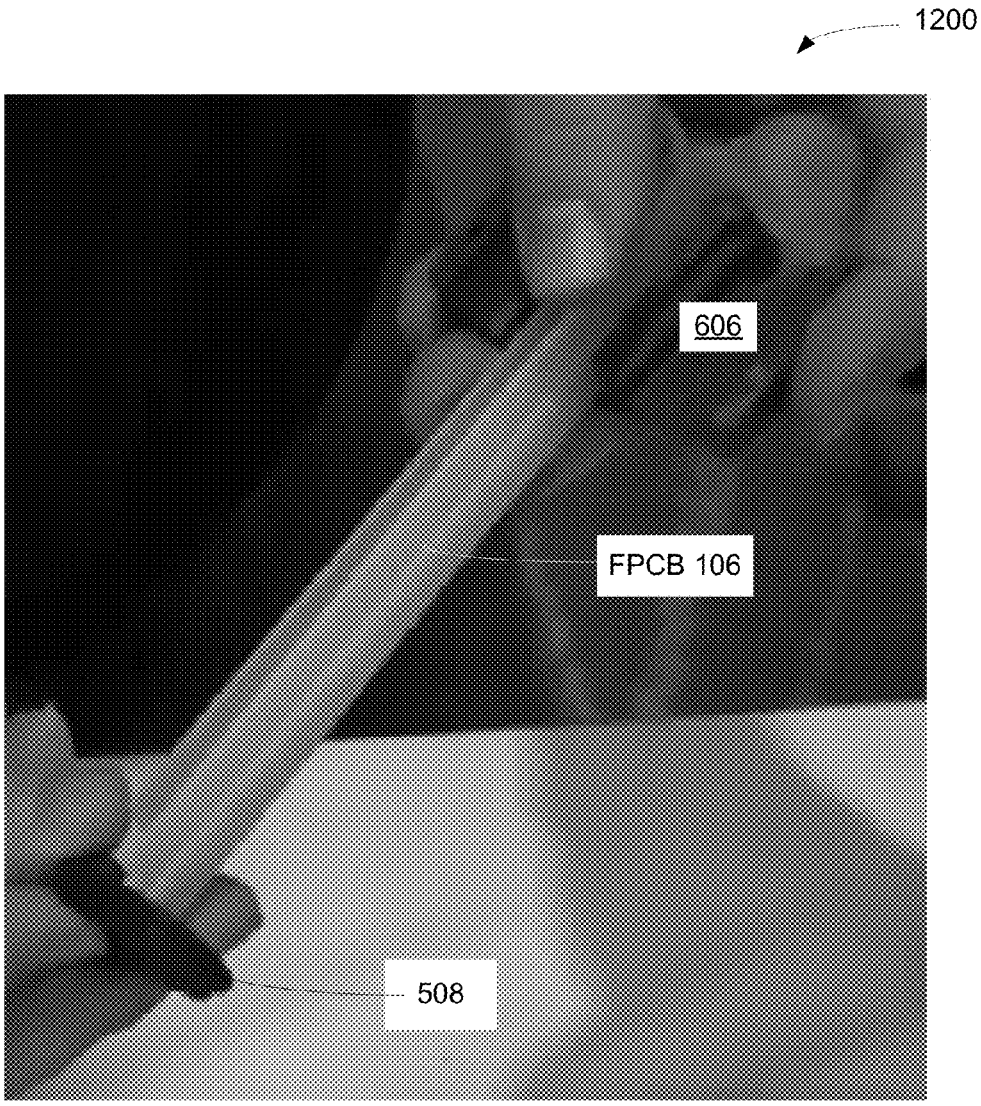
Figure 13:
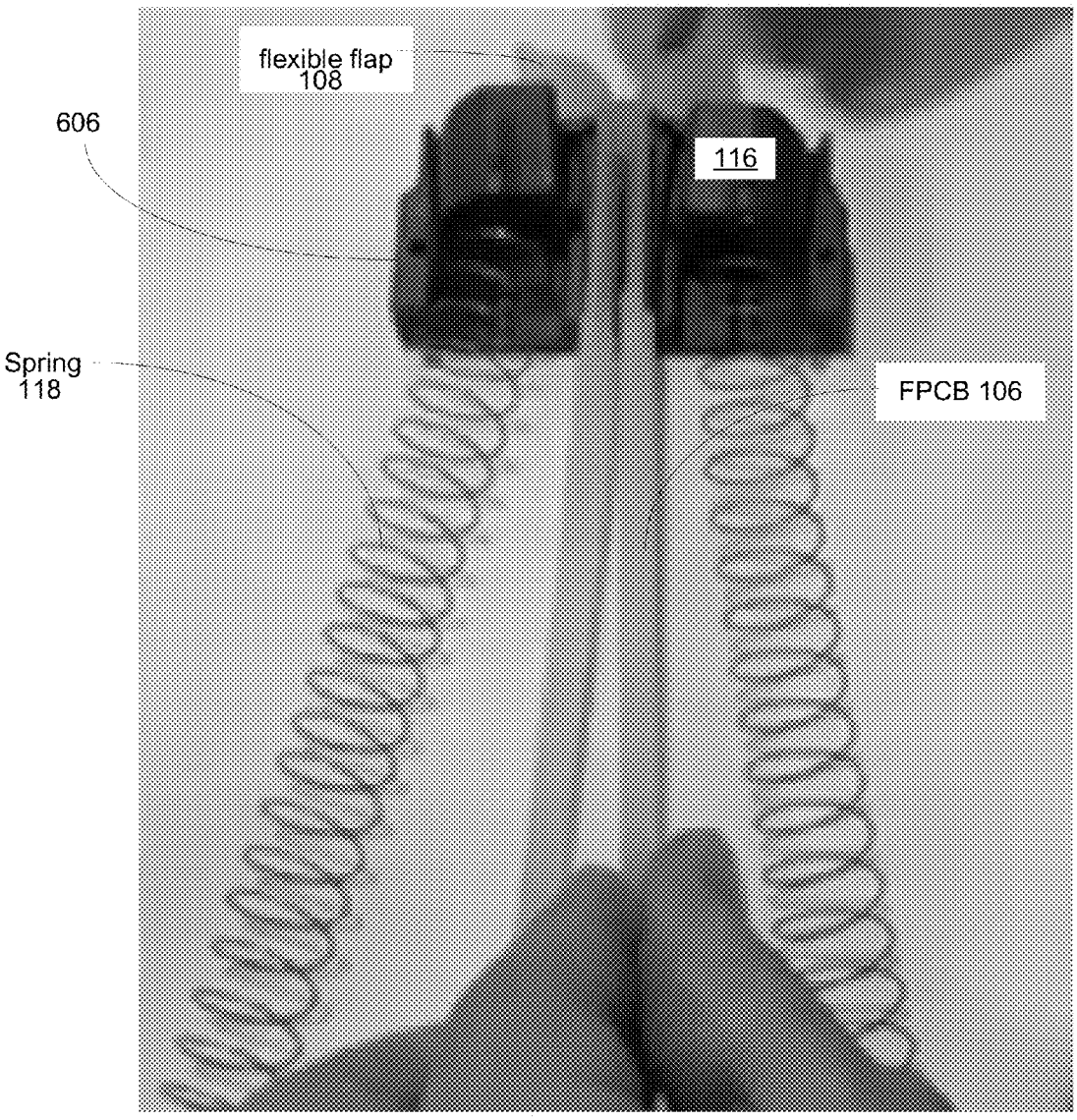

FIGS. 11-13 illustrate a tool-less Dmag assembly process in accordance with one embodiment of the present invention. Diagram 1100 illustrates two FPCBs 106, two followers 116, two springs 118, shell 502, extruder 716, two identical sets of bottom pieces 1102, projectiles 112, and launcher 1106. Diagram 1200, shown in FIG. 12, illustrates a process of snapping FPCBs 106 into slots of feed ramp 606. After inserting FPCBs 106 into slots of feed ramp 606 and positioning flexible flaps 108 in proper position, followers 116 with springs 118 are placed in the channels of feed ramp 606 as shown in FIG. 13. Once followers 116 and FPCBs 106 are aligned, they are slide into extruder 716. Extruder 716 is subsequently slide into a shell or shell 502. Upon attaching bottom pieces 1102 to shell 502, the Dmag is assembled.

Figure 14:
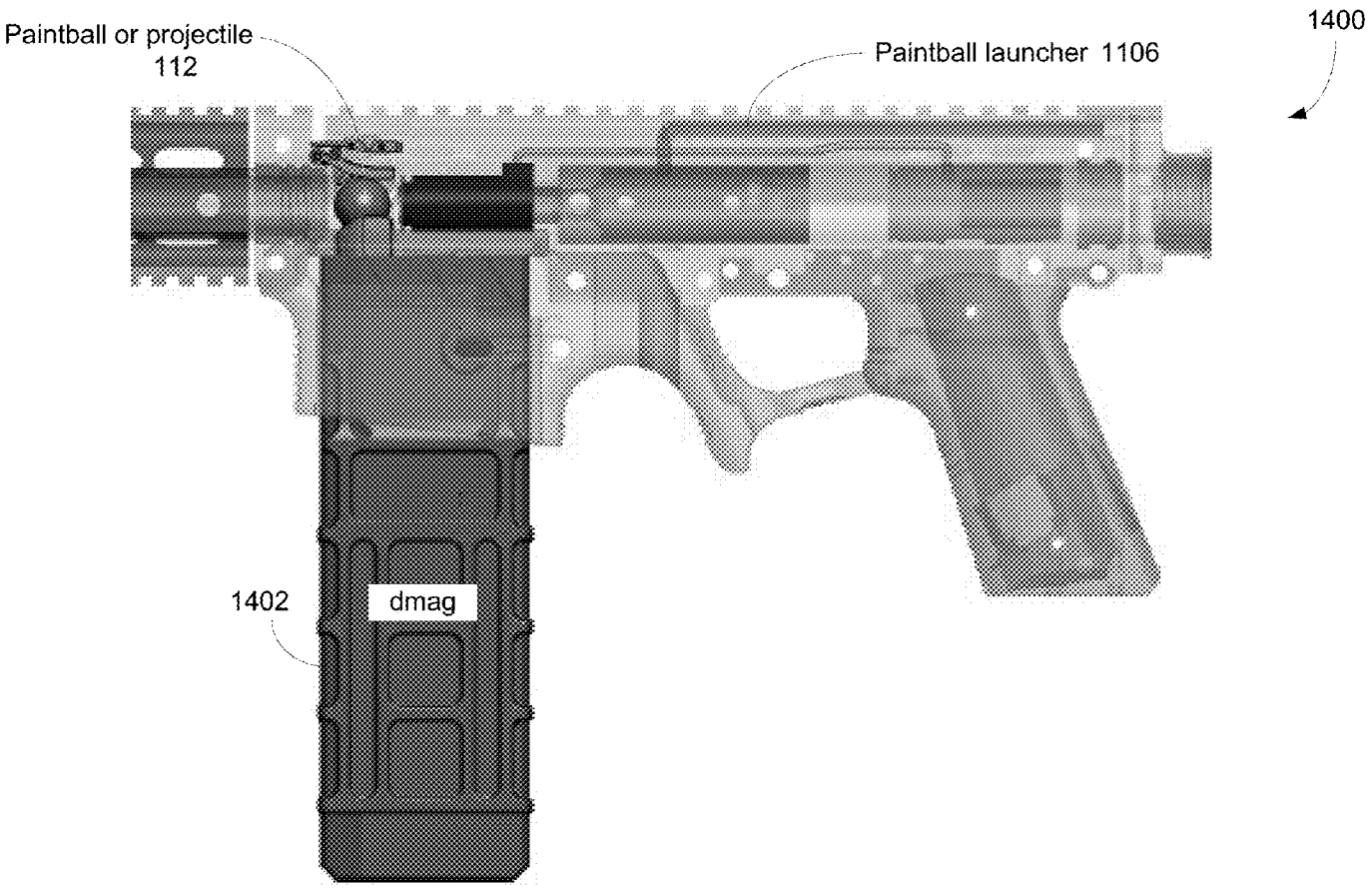
FIGS. 14-15 are diagrams illustrating a Dmag coupling to a paintball launcher in accordance with one embodiment of the present invention.

FIG. 14 is a semi-transparent diagram 1400 illustrating Dmag 1402 coupling to paintball launcher 1106 in accordance with one embodiment of the present invention. As Dmag 1402 is inserting into a magazine well or port of launcher 1106, one of the two mag-well releases is triggered that will cause the flexible flap to roll down. Once the flexible flap is retracted, the projectiles such as paintball 112 moves from the Dmag to the firing chamber of launcher 1106 as shown in diagram 1400.

Figure 15:
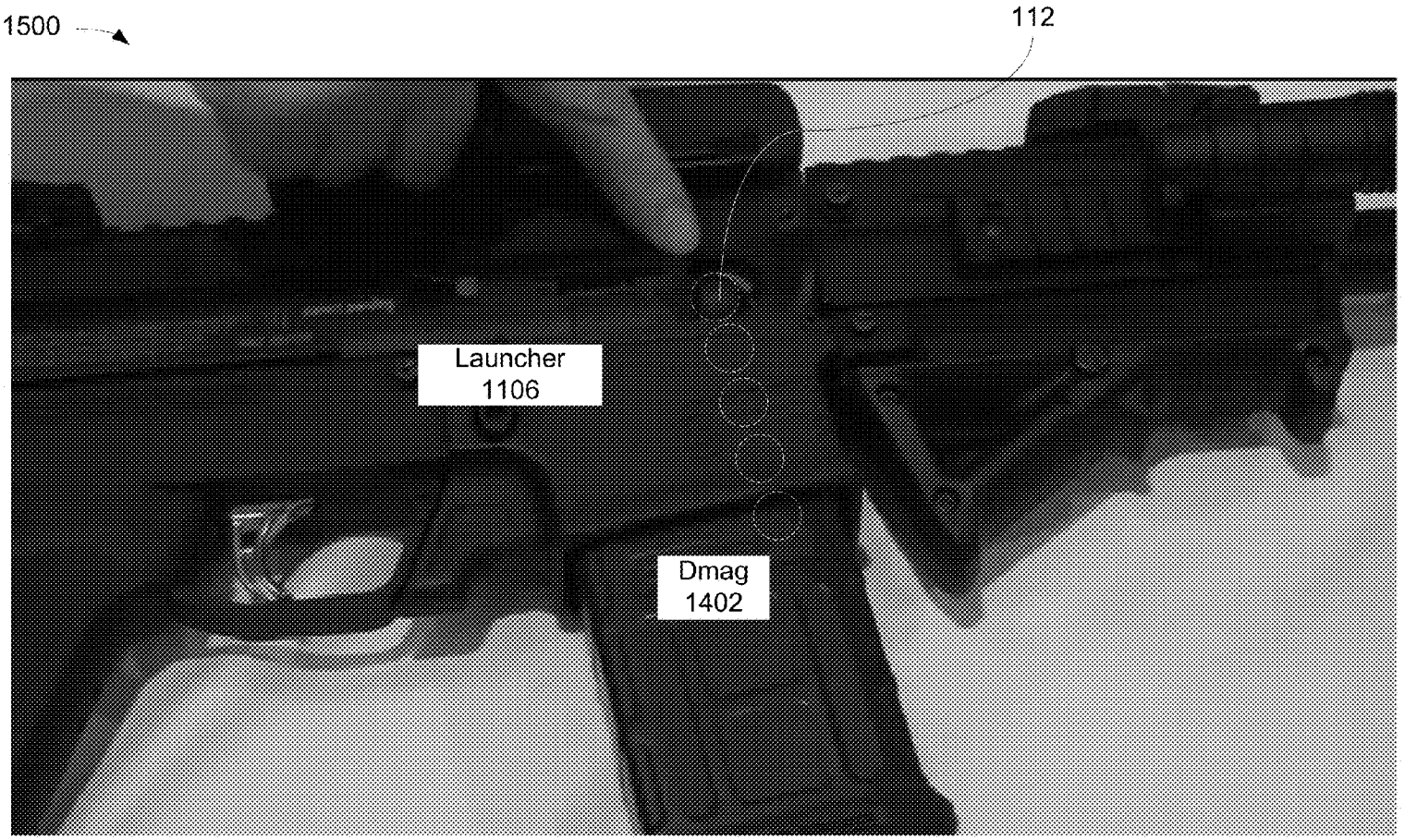

FIG. 15 is a diagram 1500 illustrating an exemplary paintball launcher which is coupled with Dmag 1402 in accordance with one embodiment of the present invention. Diagram 1500 illustrates that Dmag 1402 containing two columns of ammunition. One column of Dmag 1402, which is situated away from the user or triggering mechanism as shown in diagram 1500, is engaged to launcher 1106 for dispensing ammunition while the other column of Dmag 1402, which is situated near the user or triggering mechanism, is inactive or not engaged to launcher 1106. It should be noted that it should not matter which side of rounds or columns that is used to feed ammunition to a launcher or receiver. In an alternative embodiment, the engaged rounds or column of ammunition which is situated near the user or triggering mechanism is configured to be actively engaged with a launcher or receiver for ammunition dispensing while the other column situated away from the user is inactive or disengaged with the launcher.

The exemplary embodiment of the present invention includes various processing steps, which will be described below. For example, in FIG. 16, a process of loading and dispensing projectiles is described. In FIG. 17, a process of assembling a Dmag without use of tools is described.

Figure 16:
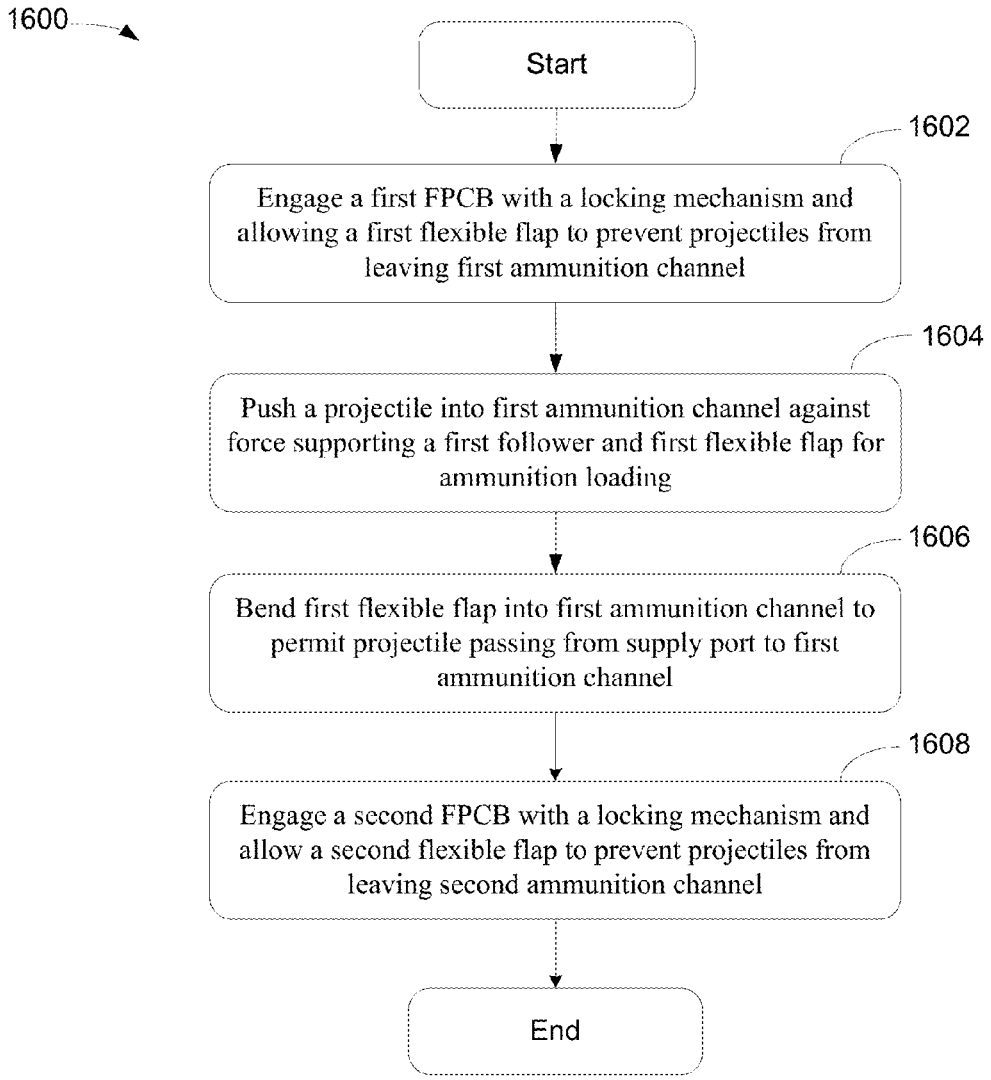
FIG. 16 is a flowchart diagram illustrating a process of loading projectiles to Dmag in accordance with one embodiment of the invention.
Figure 17:
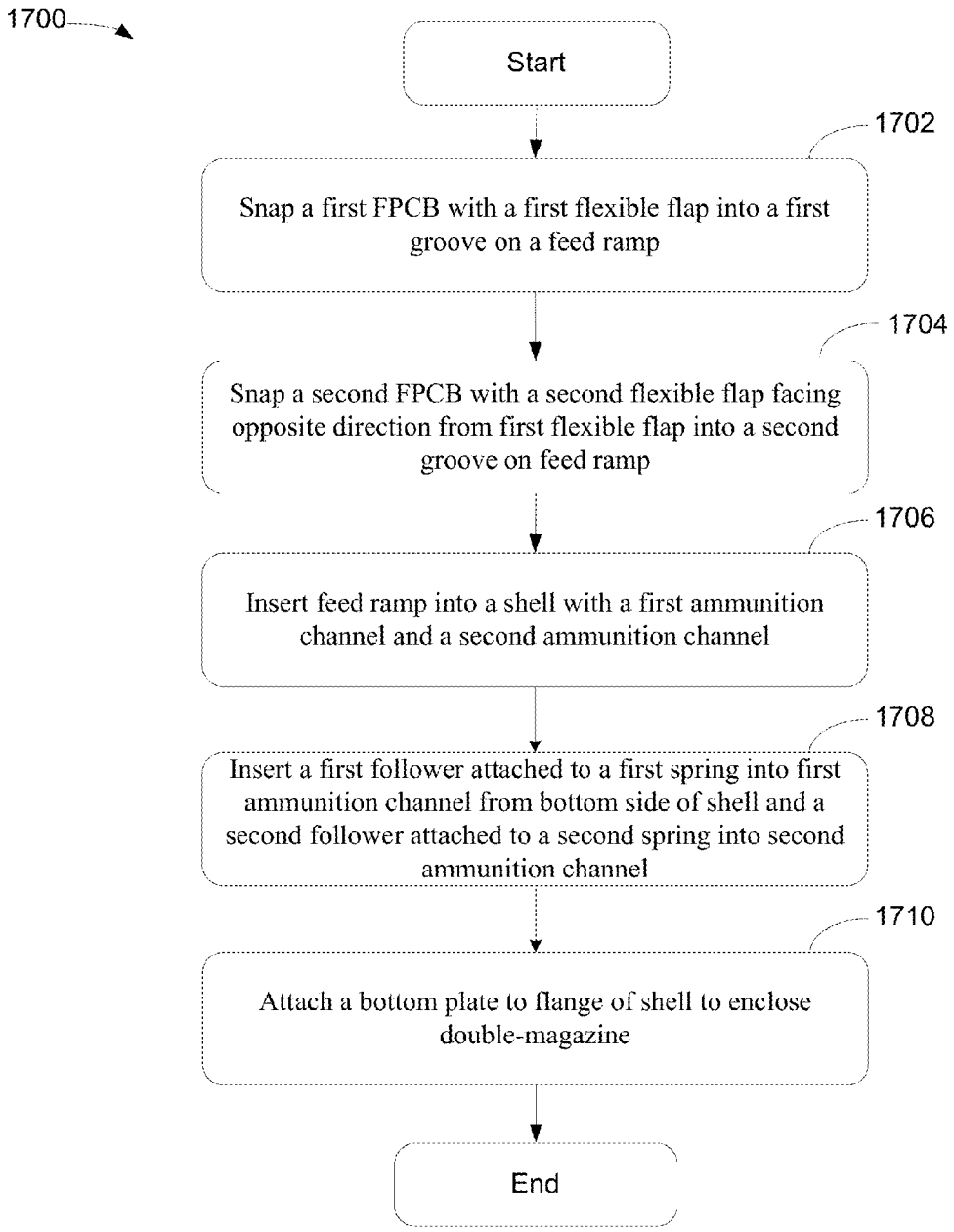
FIG. 17 is a flowchart diagram illustrating a process of tool-less Dmag assembly in accordance with one embodiment of the invention.

FIG. 16 is a flowchart 1600 illustrating a process of loading projectiles to Dmag in accordance with one embodiment of the present invention. At block 1602, a process for managing Dmag engages a first FPCB with a locking mechanism and allowing a first flexible flap of the first FPCB to cover at least a portion of first supply port of a first ammunition channel for preventing unintended projectile dispensing.

At block 1604, after pushing or loading a projectile into the first ammunition channel against a spring force supporting the first follower and the first flexible flap for ammunition loading, the first flexible flap, at block 1606, is bent into the first ammunition channel whereby permitting the projectile to pass from the supply port and to be loaded into the first ammunition channel.

At block 1608, the process engages a second FPCB with a locking mechanism that allows a second flexible flap to cover at least a portion of second supply port of a second ammunition channel to prevent projectiles from leaving the second ammunition channel. Upon pushing or loading a projectile or projectiles into the second ammunition channel against a spring force supporting the second follower and the second flexible flap, the second flexible flap is forced to bend or curve into the second ammunition channel whereby allowing the projectile to pass from the second supply port to load the projectile into the second ammunition channel. After aligning the first supply port of the Dmag with a loading port of a launcher, the Dmag is inserted or plugged into the loading port or magazine well of the launcher. The process of plugging triggers release of a first mag-well release. Release of mag-well release causes a flexible flap of FPCB to roll down. Rolling down of the first FPCB means pulling the first flexible flap toward the bottom of the Dmag whereby allowing projectiles to be loaded into the loading port of the launcher. While the first channel is actively supplying ammunition to the launcher, the second FPCB keeps the projectiles in the second ammunition channel from leaving because the second mag-well release has not been triggered yet. The second mag-well release is associated with the second FPCB. After disengaging the Dmag from the launcher and realigning the second supply port of the Dmag with the loading port of the launcher, the Dmag is inserted into the loading port of launcher which triggers the second mag-well release. After the second flexible flap rolls down, the projectiles in the second ammunition channel is allowed to be loaded into the loading port of the launcher.

FIG. 17 is a flowchart 1700 illustrating a process of assembling a Dmag without use of tools in accordance with one embodiment of the invention. At block 1702, a process of Dmag assembly snaps or inserts a first FPCB with a first flexible flap into a first slot (or groove) on a feed ramp. At block 1704, after snapping a second FPCB with a second flexible flap facing opposite direction from the first flexible flap into a second slot on the feed ramp, the feed ramp, at block 1706, is inserted into a shell with a first ammunition channel and a second ammunition channel. At block 1708, upon inserting a first follower into the first ammunition channel from the bottom side of the shell, a second follower is similarly inserted into the second ammunition channel. At block 1710, the process attaches a bottom plate to the flange of the shell to form a bottom plate for the Dmag. For example, the process is able to slide the groove of first bottom piece over a portion of the flange of the shell to attach the bottom plate to the shell.

While particular embodiments of the present invention have been shown and described, it will be obvious to those of ordinary skills in the art that based upon the teachings herein, changes and modifications may be made without departing from this exemplary embodiment(s) of the present invention and its broader aspects. Therefore, the appended claims are intended to encompass within their scope all such changes and modifications as are within the true spirit and scope of this exemplary embodiment(s) of the present invention.

What is claimed is:

1. An ammunition magazine, comprising:

a first ammunition channel able to house a first plurality of projectiles;

a second ammunition channel situated in parallel to the first ammunition channel and configured to house a second plurality of projectiles;

a first follower, having a first follower lock, able to move inside the first ammunition channel and configured to push the first plurality of projectiles toward a first ammunition supply port of the first ammunition channel; and a first flexible projectile control bar ("FPCB") situated adjacent to the first ammunition channel and configured to have a first flexible flap extending from one end of the first FPCB, wherein the first flexible flap keeps the first plurality of projectiles from leaving the first ammunition channel until a magazine well ("mag-well") release is triggered.

2. The magazine of claim 1, further comprising a first spring having a top end and a bottom end wherein the top end attaches to bottom side of the first follower and the bottom end attaches to a bottom plate of the ammunition magazine.

3. The magazine of claim 2, further comprising a shell, having a top end and a bottom end, configured to provide the first ammunition channel, the second ammunition channel, and the first FPCB, wherein the top end of shell includes supply ports and the bottom end of shell contains a flange wherein the flange facilitates engagement to the bottom plate.

4. The magazine of claim 3, further comprising a first gate lock situated adjacent to the bottom plate and configured to lock the first follower in a predefined position within the first ammunition channel.

5. The magazine of claim 1, further includes two substantially identical bottom pieces to form a bottom plate of the ammunition magazine, wherein each of the bottom piece includes a locking hook and a groove.

6. The magazine of claim 5, wherein the bottom piece is attached to the shell by sliding the groove of the bottom piece over the flange of the shell.

7. The magazine of claim 1, wherein a first FPCB is able to roll down toward to bottom side of magazine which allows the projectiles to reach a loading port of a launcher.

8. The magazine of claim 1, further comprising a second follower, having a second follower lock, able to move inside the second ammunition channel and configured to push the second plurality of projectiles toward a second ammunition supply port of the second ammunition channel.

9. The magazine of claim 1, further comprising a second FPCB situated adjacent to the first FPCB and configured to have a second flexible flap extending from one end of the second FPCB, wherein the second flexible flap is configured to keep the second plurality of projectiles from reaching a loading port of a launcher until a mag-well release associated with the second FPCB is triggered.

10. The magazine of claim 1, wherein the projectiles are paintballs.

11. The magazine of claim 1, wherein the projectiles are breakable lethal delivery capsules.

12. A method of providing projectiles from a double-magazine to a launcher, comprising:

engaging a first flexible projectile control bar ("FPCB") with a locking mechanism and allowing a first flexible flap of the first FPCB to cover at least a portion of first supply port of a first ammunition channel to prevent projectiles from dispensing;

pushing a projectile into the first ammunition channel against a force supporting a first follower and the first flexible flap for ammunition loading;

sufficiently bending the first flexible flap into the first ammunition channel permitting the projectile to pass from the supply port into the first ammunition channel for ammunition storage; and engaging a second FPCB with a locking mechanism allowing a second flexible flap to cover at least a portion of second supply port of a second ammunition channel preventing projectiles from leaving the second ammunition channel.

13. The method of claim 12, further comprising pushing a second projectile into the second ammunition channel against force supporting a second follower and the second flexible flap for ammunition loading.

14. The method of claim 13, further comprising forcing the second flexible flap to bend into the second ammunition channel for allowing the second projectile to pass from the second supply port into the second ammunition channel for ammunition storage.

15. The method of claim 14, comprising:

aligning the first supply port of the first ammunition channel of the double-magazine ("Dmag") to a loading port of a launcher;

inserting the Dmag into the loading port of launcher and triggering a first magazine well ("mag-well") release; and rolling down the first FPCB with the first flexible flap toward bottom portion of the Dmag and allowing a plurality of projectiles to reach the loading port of the launcher.

16. The method of claim 15, comprising engaging the flexible flap of the second FPCB to maintain the plurality of projectiles in the second ammunition channel from leaving when a second mag-well release is not triggered.

17. The method of claim 16, comprising:

disengaging the Dmag from the launcher and realigning the second supply port of the second ammunition channel of the Dmag with the loading port of the launcher; and inserting the Dmag into the loading port of launcher and triggering the second mag-well release.

18. The method of claim 17, comprising rolling down the second FPCB with the second flexible flap toward bottom portion of the Dmag and allowing a plurality of projectiles in the second ammunition channel to be loaded into the loading port of the launcher.

19. A method of assembling a double-magazine for housing projectiles, comprising:

snapping a first flexible projectile control bar ("FPCB") with a first flexible flap into a first groove on a feed ramp;

snapping a second FPCB with a second flexible flap facing opposite direction from the first flexible flap into a second groove on the feed ramp;

inserting the feed ramp into a shell with a first ammunition channel and a second ammunition channel;

inserting a first follower with a first spring into the first ammunition channel from bottom side of the shell and a second follower with a second spring into the second ammunition channel; and attaching a bottom plate to a flange of the shell to enclose bottom section of the double-magazine.

20. The method of claim 19, wherein attaching a bottom plate to flange of the shell further includes sliding a groove of a first bottom piece over a portion of the flange of the shell.

* * * * *